US011177586B2

(12) United States Patent
Reinhardt

(10) Patent No.: US 11,177,586 B2
(45) Date of Patent: Nov. 16, 2021

(54) CONTACT DEVICE AND SYSTEM

(71) Applicant: TE Connectivity Germany GmbH, Bensheim (DE)

(72) Inventor: Marc Reinhardt, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 78 days.

(21) Appl. No.: 16/698,414

(22) Filed: Nov. 27, 2019

(65) Prior Publication Data

US 2020/0176898 A1 Jun. 4, 2020

(30) Foreign Application Priority Data

Nov. 29, 2018 (DE) ..... 102018130304.1

(51) Int. Cl.

| | |
|---|---|
| ***H01R 11/22*** | (2006.01) |
| ***H01R 4/48*** | (2006.01) |
| ***H01R 13/6583*** | (2011.01) |
| ***H01R 13/18*** | (2006.01) |

(52) U.S. Cl.
CPC ..... *H01R 4/4881* (2013.01); *H01R 13/18* (2013.01); *H01R 13/6583* (2013.01)

(58) Field of Classification Search
CPC ..... H01R 4/4881; H01R 13/15; H01R 13/18; H01R 13/6583
USPC ..... 439/816–819
See application file for complete search history.

(56) References Cited

U.S. PATENT DOCUMENTS

| | | | | |
|---|---|---|---|---|
| 9,373,901 | B2 | 6/2016 | Singer et al. | |
| 9,761,995 | B2 * | 9/2017 | Little | H01R 13/6581 |
| 9,866,006 | B2 | 1/2018 | Albert et al. | |
| 10,790,611 | B1 * | 9/2020 | Huang | H02G 3/0675 |
| 2011/0189888 | A1 | 8/2011 | Rhein | |

FOREIGN PATENT DOCUMENTS

| | | | |
|---|---|---|---|
| DE | 102014210254 | B3 | 11/2015 |
| DE | 102012217465 | B4 | 9/2016 |
| WO | 2014048929 | A1 | 4/2014 |
| WO | 2015007745 | A1 | 1/2015 |

OTHER PUBLICATIONS

German Office Action, German Patent Application No. 10 2018 130 304.1, dated Nov. 19, 2019, 4 pages.

* cited by examiner

*Primary Examiner* — Khiem M Nguyen
(74) *Attorney, Agent, or Firm* — Barley Snyder

(57) ABSTRACT

A contact device includes a first contact housing extending along a longitudinal axis and a shielding-spring unit electrically and mechanically connected to the first contact housing. The shielding-spring unit contacts an electrically conductive housing of a system. The shielding-spring unit has a first shielding spring and a second shielding spring arranged in a rotated manner relative to the first shielding spring in a circumferential direction around the longitudinal axis. The first shielding spring and the second shielding spring engage one another and lie against one another in an axial direction.

21 Claims, 5 Drawing Sheets

CONTACT DEVICE AND SYSTEM

CROSS-REFERENCE TO RELATED APPLICATION

This application claims the benefit of the filing date under 35 U.S.C. § 119(a)-(d) of German Patent Application No. 102018130304.1, filed on Nov. 29, 2018.

FIELD OF THE INVENTION

The present invention relates to a contact device and, more particularly, to a contact device with a shielding spring.

BACKGROUND

A spring collar for a shielding of electrical plug connections is disclosed in German Patent Application No. 10201410254 B3.

SUMMARY

A contact device includes a first contact housing extending along a longitudinal axis and a shielding-spring unit electrically and mechanically connected to the first contact housing. The shielding-spring unit contacts an electrically conductive housing of a system. The shielding-spring unit has a first shielding spring and a second shielding spring arranged in a rotated manner relative to the first shielding spring in a circumferential direction around the longitudinal axis. The first shielding spring and the second shielding spring engage one another and lie against one another in an axial direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
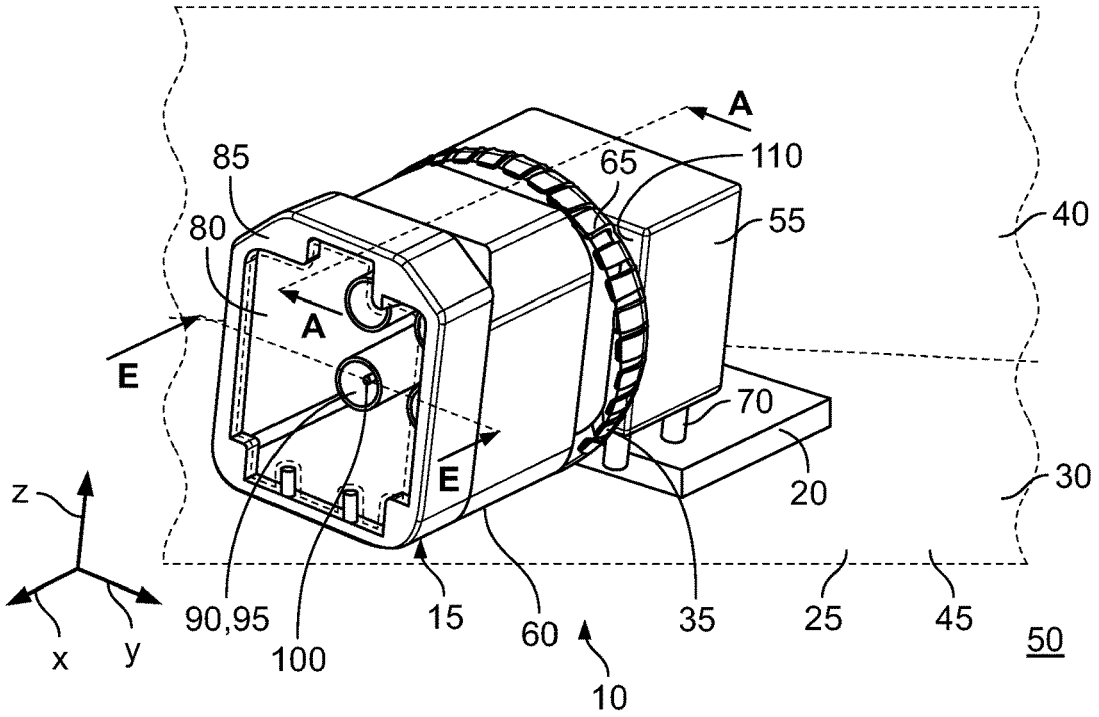
FIG. 1 is a perspective view of a system with a contact device, a printed circuit board, and a housing.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art. The embodiments described herein are each independent of one another and can be combined with one another as desired, depending on necessity in a specific application.

For greater ease of understanding, the following figures make reference to a coordinate system. The coordinate system has an x-axis (longitudinal direction), a y-axis (transverse direction) and a z-axis (height direction). The coordinate system is formed by way of example as a right-handed system.

A control apparatus formed as a system 10 according to an embodiment, as shown in FIG. 1, comprises a contact device 15, a printed circuit board 20, and a housing 25. The housing 25 is shown schematically in FIG. 1 for each of understanding.

The housing 25, as shown in FIG. 1, delimits a housing interior 30. The printed circuit board 20 is arranged in the housing interior 30. The printed circuit board 20 is formed in a plate-shaped manner and extends in an xy-plane. Electrical components, such as a transmitter and/or a receiver, can be arranged on the printed circuit board 20. The transmitter and/or the receiver can be for high-frequency signals, such as in a range of 0.1 to 100 GHz, or in a range from 0.1 to 20 GHz. Components which generate signals with another frequency spectrum, for example from a range of 0 to 0.1 GHz, can also be arranged on the printed circuit board 20. The transmitter and/or the receiver is electrically connected to the contact device 15 by the printed circuit board 20.

The housing 25, as shown in FIG. 1, has a first through-hole 35. The first through-hole 35 has, by way of example, a circular cross-section. In the embodiment, the housing 25 can be formed in two parts and have a first housing part 40 and a second housing part 45 arranged on the lower side of the first housing part 40. The housing parts 40, 45 are formed as half shells. The first housing part 40, together with the second housing part 45, delimits the housing interior 30, the housing parts 40, 45 abutting one another at the first through-hole 35, and the first through-hole 35 being arranged in a section-wise manner on both sides both in the first housing part 40 and in the second housing part 45.

In an embodiment, the housing 25 is produced from an electrically conductive substance, for example a zinc-copper die cast metal or from a zinc die cast metal. The housing 25 electrically shields the printed circuit board 20 and thus the components arranged on the printed circuit board 20, for example the transmitter and/or the receiver, from a surrounding environment 50 of the system, for example of the control apparatus 10.

The contact device 15 for transmitting the high-frequency signal generated by the components, as shown in FIG. 1, has at least one coaxial contact 90, and in an embodiment, several coaxial contacts 90. Each coaxial contact 90 has a shielding contact 95, which circumferentially electrically shields a signal contact 100. The shielding contact 95 is electrically insulated from the signal contact 100 and the shielding contact 95 is arranged coaxially relative to the signal contact 100.

As shown in FIG. 1, the contact device 15 has a first contact housing 55, a second contact housing 60, and a shielding-spring unit 65. The first contact housing 55 has, by way of example, several attaching feet 70, with which the first contact housing 55 is connected mechanically, and in an embodiment electrically for a ground connection, to the printed circuit board 20.

The attaching foot 70, or several attaching feet 70 in an embodiment, engage with the printed circuit board 20, as shown in FIG. 1. In a housing section 125, the first contact housing 55 has a substantially cuboid basic shape. The first contact housing 55 has an electrically conductive substance, such as a copper substance or a zinc-copper substance. In an embodiment, the first contact housing 55 is produced by a die-cast metal. At a first face side 110 arranged on a side of the first contact housing 55 facing the first through-hole 35, the first contact housing 55 is connected to the second contact housing 60 and the shielding-spring unit 65. The first face side 110 is formed planarly by way of example and extends in a yz-plane. The first face side 110 is arranged parallel to a plane in which the first through-hole 35 is arranged. The first contact housing 55 is arranged in the housing interior 30 in a section-wise manner.

The second contact housing 60 is arranged outside the housing interior 30 and is formed in the embodiment as a coding cap. The second contact housing 60, in an embodiment, has an electrically insulating substance. The substance of the coding cap can also be electrically conductive in another embodiment. The second contact housing 60 has a receptacle 80, with a further contact device 85 able to be inserted into the receptacle 80 on a side facing away from the first contact housing 55, in order to configure an electrical contact to the coaxial contact 90.

Figure 2:
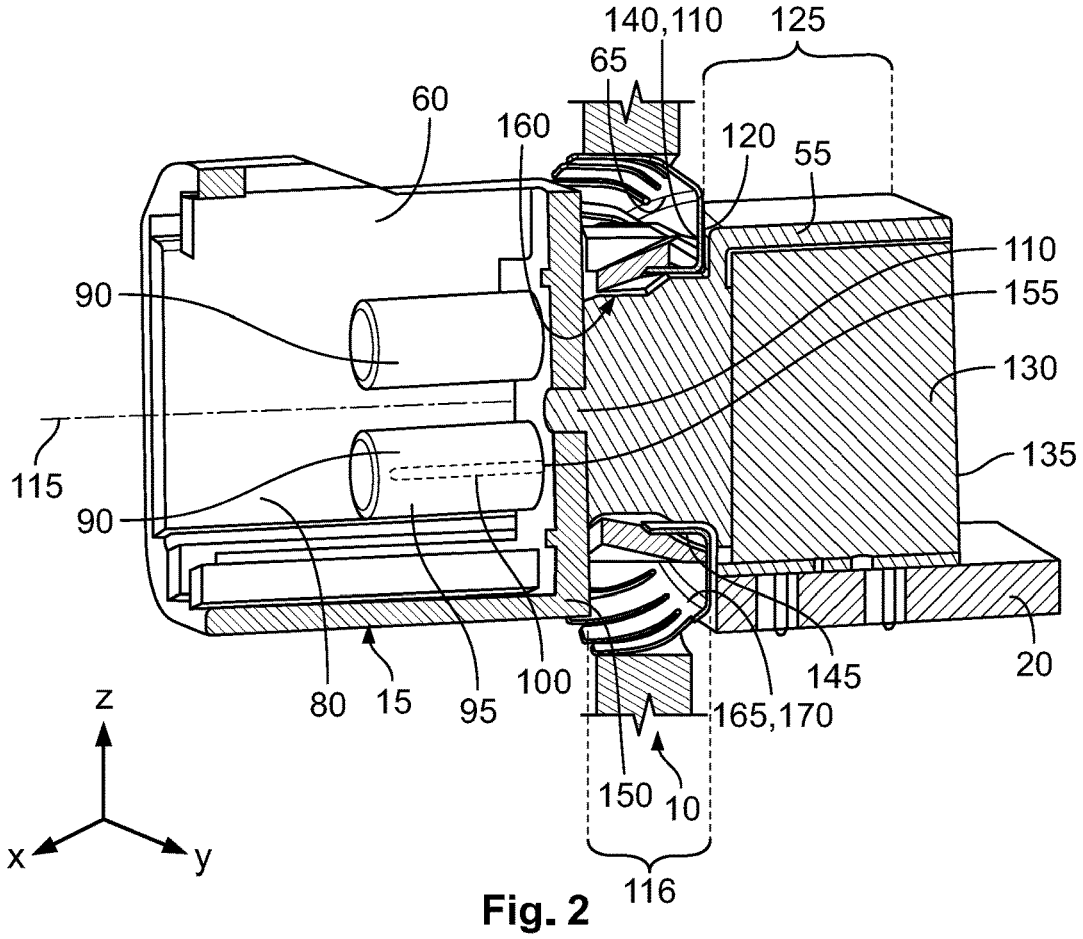
FIG. 2 is a sectional perspective view of the system, taken along line A-A of FIG. 1.

As shown in FIG. 2, the shielding contact 95 is electrically connected to the first contact housing 55, and to ground via the first contact housing 55. The coaxial contact 90, at the face side, protrudes beyond a first face side 110 of the first contact housing 55 and extends parallel to a longitudinal axis 115. The longitudinal axis 115 is arranged parallel to the x-axis. The further contact device 85 is inserted into the receptacle 80 along the longitudinal axis 115. The further contact device 85 configures an electrical contact to the coaxial contact 90, and in an embodiment, with all coaxial contacts 90.

The first contact housing 55, as shown in FIG. 2, has an engagement section 116 between the coaxial contact 90 and the first face side 110. The engagement section 116 has, at a first outer circumferential side 120, a substantially rectangular configuration in a cross-section perpendicular to the longitudinal axis 115. In this case, the engagement section 116 can be formed to be rounded at side edges. The engagement section 116 and the housing section 125 are formed integrally and in a materially uniform manner.

On a side facing away from the coaxial contact 90, the housing section 125 is joined to the engagement section 116 as shown in FIG. 2. The housing section 125 of the first contact housing 55 delimits a contact housing interior 130, with a retainer 135 for fixing a non-depicted electrical connection between the coaxial contact 90 and the printed circuit board 20 being arranged in the contact housing interior 130. The attaching feet 70 are arranged on the housing section 125 on the lower side.

The housing section 125 is formed in a substantially cuboid shape and is formed to be wider in the transverse direction and in the height direction than the engagement section 116, as shown in FIG. 2. On the first face side 115, an offset 140 is formed at a transition between the first outer circumferential side 120 of the engagement section 116 and the housing section 125.

As shown in FIG. 2, the second contact housing 60 has, in addition to the receptacle 80, a further receptacle 145 on a longitudinal side facing the first contact housing 55. The further receptacle 145 is, on the face side, on a side facing the receptacle 80, separated from the receptacle 80 by a wall 150, with one second through-hole 155 for each coaxial contact 90 being arranged in the wall 150. The second through-hole 155 is engaged through by the coaxial contact 90. The wall 150 extends substantially in a yz-plane. The further receptacle 145 is open on the side facing towards the first contact housing 55. The engagement section 116 engages with the further receptacle 145.

As shown in FIG. 2, a catch device 160 can be provided. The catch device 160 attaches the first contact housing 55 on the engagement section 116 to the second contact housing 60 on the further receptacle 145 in a form-fitting manner. The further receptacle 145 and the engagement section 116 match one another such that a rotation of the second contact housing 60 around the longitudinal axis 115 relative to the engagement section 116 is blocked.

The shielding-spring unit 65, as shown in FIG. 2, has a first shielding spring 165 and a second shielding spring 170 arranged rotated around the longitudinal axis 115, by 90° in an embodiment. The first shielding spring 165 can be formed identically to the second shielding spring 170. The first shielding spring 165 can also be formed differently from the second shielding spring 170. The second shielding spring 170 and the first shielding spring 165 engage with one another and lie at least axially against one another in a section-wise manner. As a result, in addition to the mechanical connection through the engagement of the two shielding springs 165, 170 with one another, the first shielding spring 165 is also electrically connected to the second shielding spring 170. The shielding-spring unit 65 is arranged on the outside of the engagement section 116 and thereby lies against the engagement section 116, and also against the offset 140, so that the shielding-spring unit 65 is electrically connected to the first contact housing 55.

Figure 3:
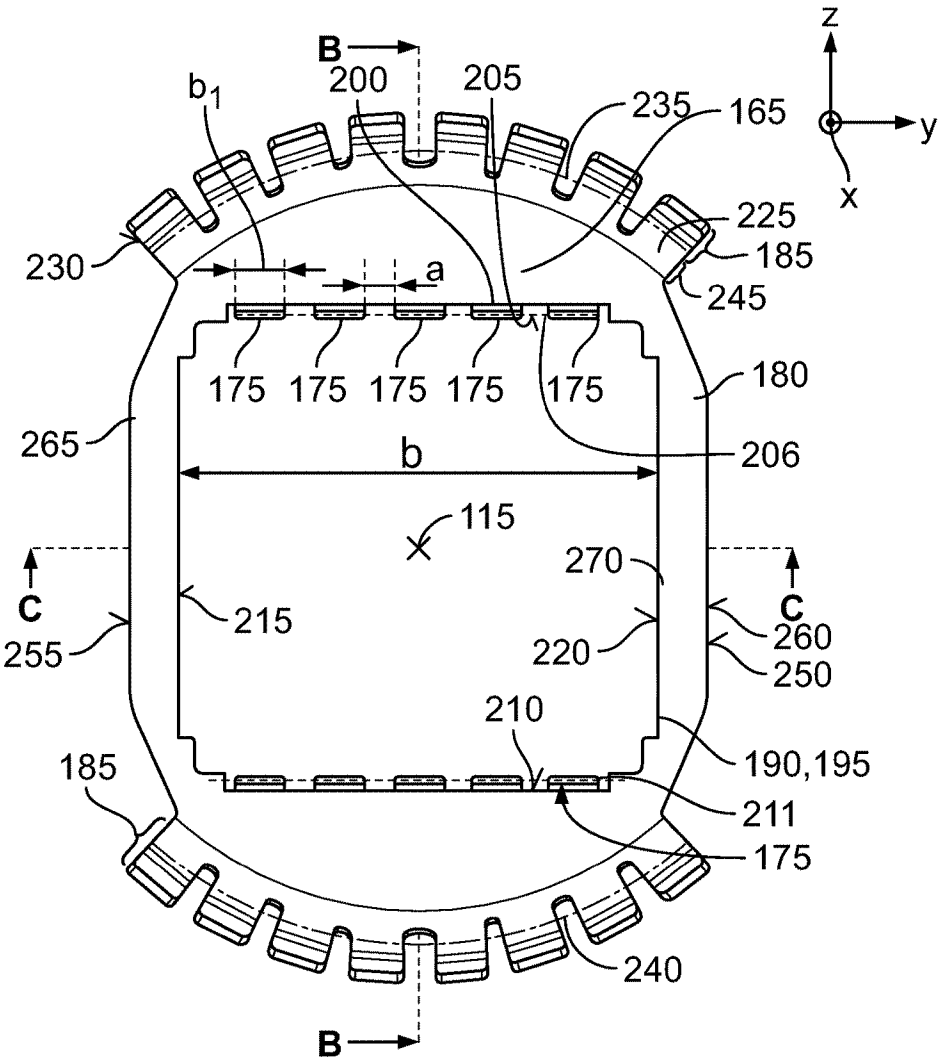
FIG. 3 is a top view of a first shielding spring.

As shown in FIG. 3, the first shielding spring 165 has a first spring section 175, a first attaching section 180, and a second spring section 185. The first shielding spring 165 is formed integrally and in a materially uniform manner. In an embodiment, the first spring section 175, the first attaching section 180, and the second spring section 185 are produced by a stamping and bending method, from a flat sheet. The first shielding spring 165, in an embodiment, contains at least a steel, in particular a spring steel, or a copper alloy.

The first attaching section 180, as shown in FIG. 3, extends substantially in a yz-plane and is formed planarly. An aperture 190 is arranged in a central location, by way of example, in the first attaching section 180. The aperture 190 has a substantially rectangular basic shape. In this case, a corner region of the aperture 190 can be formed to be rounded. The aperture 190 has an aperture profile 195, wherein the aperture profile 195, in an at least section-wise manner, is formed to correspond (at least laterally) to the first outer circumferential side 120 of the engagement section 116, as a result of which the first shielding spring 165 is provided with protection against rotation relative to the engagement section 116.

On the upper side and lower side in FIG. 3, by way of example at the aperture profile 195, the first spring section 175 is connected to the first attaching section 180 by a first fixed end 200. In this case, several first spring sections 175 arranged in a first row 206 are arranged with regular spacing from one another on an upper side 205 of the aperture profile 195. The upper side 205 in this case extends in an xy-plane. The first spring sections 175 extend substantially over a predominant part of a first maximum width b1 of the aperture 190. In this case, a first number of first spring sections, for example five first spring sections 175, is arranged in the embodiment. A minimum spacing a of the first spring sections 175 relative to one another is smaller than a second maximum width b1 of the first spring sections 175 in the transverse direction.

In the height direction, as shown in FIG. 3, spaced apart from the upper side 205, the aperture profile 195 has a lower side 210 parallel to the upper side 205. At the lower side 210, a second row 211 of first spring sections 175 is arranged opposite the first row 206 of first spring sections 175 in the height direction, wherein each individual first spring section 175 is arranged directly opposite in the height direction. The first number of first spring sections 175 of the second row 211 is identical to the first number of first spring sections 175 of the first row 206. The upper side 205 is connected to the lower side 210 by first and second side surfaces 215, 220 of the aperture profile 195 which are each formed planarly, by way of example. The side surfaces 215, 220 each extend in xz-planes which are arranged offset in the transverse direction.

In the embodiment shown in FIG. 3, the first shielding spring 165 has, radially on the outside, a third row 235 of second spring sections 185 and, in the circumferential direction relative to the third row 235, an arranged fourth row 240 of second spring sections 185. The third and fourth rows 235, 240 extend, by way of example, over approximately an angle segment of 30° and each have the same second number of second spring sections 185. The second number is, by way of example, larger than the first number of first spring sections 175. In this case, the third and fourth rows 235, 240 are arranged on a common orbit 230 around the longitudinal axis 115.

As shown in FIG. 3, a connecting section 245 can be provided between the second spring section 185 and the planarly formed first attaching section 180. The connecting section 245 is formed in a substantially conical manner. In the embodiment, the second spring sections 185 are connected by the second fixed end 225 to the first attaching section 180 via the connecting section 245. It is also possible to dispense with the connecting section 245, so that the second spring sections 185 are directly connected to the first attaching section 180 by the second fixed end 225.

The second outer circumferential side 250 has a first section 255 and a second section 260, as shown in FIG. 3. The first section 255 is formed planarly and is oriented parallel to the first side surface 215. The second section 260 is formed planarly and is oriented parallel to the second side surface 220. The first side surface 215 and the first section 255 of the second outer circumferential side 250 delimit a first web section 265 of substantially constant width, and the second side surface 220, together with the second section 260, delimits a second web section 270 of substantially constant width. The first web section 265 and the second web section 270 connect the upper side 205 to the lower side 210.

Figure 4:
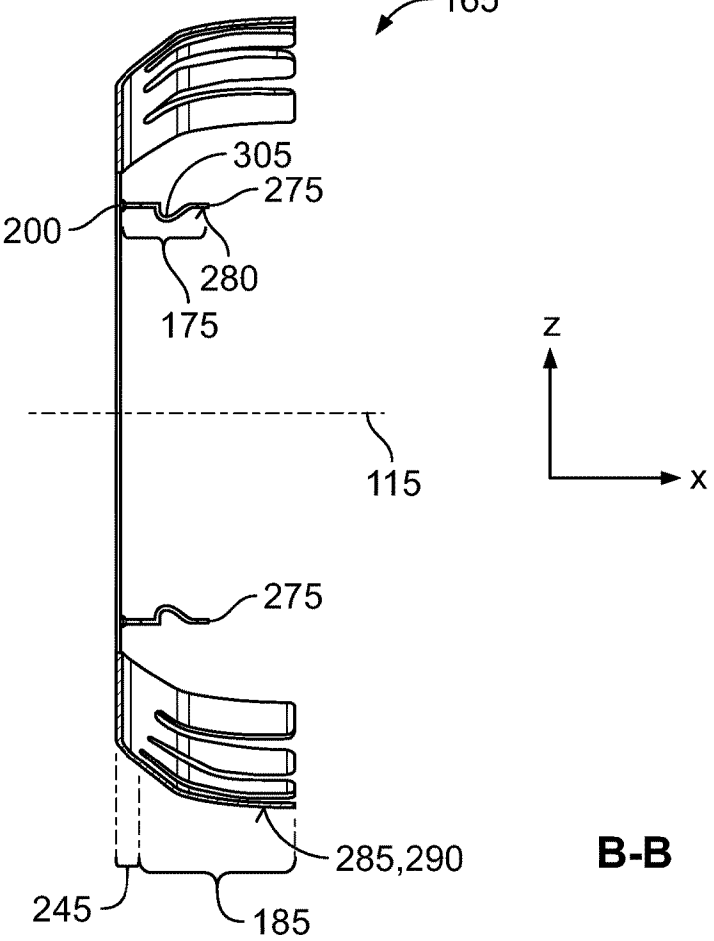
FIG. 4 is a sectional side view of the first shielding spring, taken along line B-B of FIG. 3.

As shown in FIG. 4, the first spring section 175 and/or the second spring section 185 can each be formed like a bar spring. Furthermore, the first spring section 175 and the second spring section 185 are arranged axially on a common side of the first attaching section 180. In the mounted state, the first spring section 175 extends substantially parallel to the longitudinal axis 115. In an unmounted state (as shown in FIG. 4), a free end 275 can have a smaller spacing from the longitudinal axis 115 than the first fixed end 200. On the inside, the first spring section 175 has a first contact surface 280.

The second spring section 185 is formed to be curved, as shown in FIG. 4. The second spring section 185 extends radially outwards in an arcuate manner and is arranged running obliquely relative to the longitudinal axis 115. The second spring section 185 has a second contact surface 290 on a third outer circumferential side 285.

As shown in FIG. 4, in the longitudinal direction, the first spring section 175, by way of example, is formed to be shorter than the second spring section 185. Of course, it is also conceivable that the first spring section 175 is of the same length as, or is formed to be longer than, the second spring section 185 in the longitudinal direction.

Figure 5:
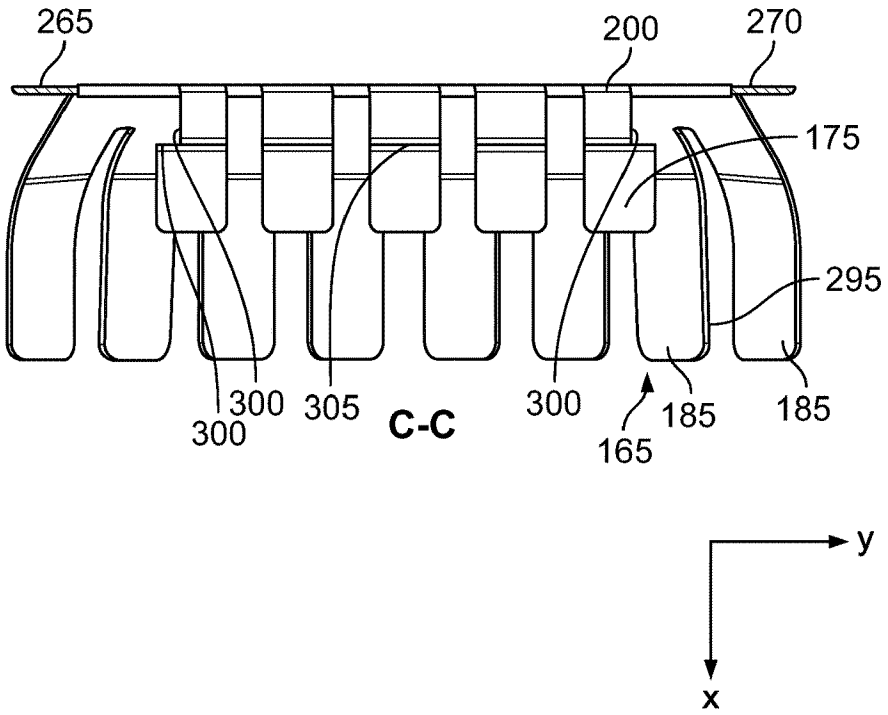
FIG. 5 is a sectional side view of the first shielding spring, taken along line C-C of FIG. 3.

As shown in FIGS. 3 and 5, the second spring sections 185 are arranged distributed on the orbit 230 with regular spacing inside the third and/or fourth row 235, 240. In this case, the individual second spring sections 185 are arranged separated from one another by a gap 295 formed in a V-shape. The second spring sections 185 are formed identically to one another and are arranged spaced apart from one another with regular spacing in the circumferential direction with regard to the longitudinal axis 115.

The first spring section 175, as shown in the embodiment of FIG. 5, has a constriction 300 on a side facing the first and/or second web section 265, 270. It is also possible to dispense with the constriction 300. The constriction 300 is joined to the first fixed end 200 in the height direction. In the shown embodiment, the constriction 300 is formed to be rectangular. The constriction 300 is provided so that the first shielding spring 165 can be stamped from a planar metal sheet in the stamping and bending method. No constriction 300 is provided at the further first spring sections 175 arranged between the first spring section 175, so that the first spring section 175 is formed to be substantially rectangular.

As shown in FIG. 5, a bulge 305 which extends in the transverse direction over the entire width of the first spring section 175 can be provided in the longitudinal direction, approximately at the mid-height. The bulge 305 is represented from the outside as an indentation. The bulge 305 extends from the outside inwards and serves to stiffen the first spring section 175. With the exception of the constriction 300, the first spring sections 175 are formed identically to one another. Furthermore, the first spring sections 175 run parallel to one another.

The first shielding spring 165 and the second shielding spring 170 are formed identically to one another, wherein below, for greater ease of understanding, the first spring section 175, which is for the second shielding spring 170 and which is described in the context of the first shielding spring 165, is referred to as the third spring section 310, the first attaching section 180, which is for the second shielding spring 170 and which is described in the context of first shielding spring 165, is referred to as the second attaching section 315 and the second spring section 185, which is for the second shielding spring 170 and which is described in the context of first shielding spring 165, is referred to as the fourth spring section 320.

Figure 6:
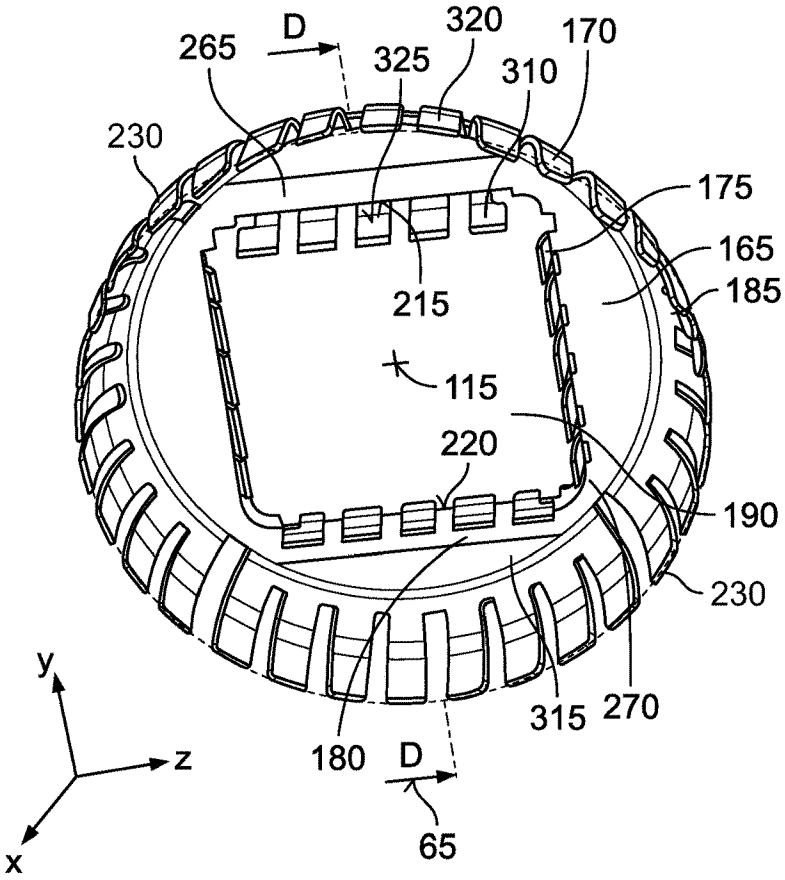
FIG. 6 is a front perspective view of a shielding spring unit.

As shown in FIG. 6, the second shielding spring 170 is arranged rotated in the circumferential direction around the longitudinal axis 115, by 90° in an embodiment, relative to the first shielding spring 165. The third spring section 310 of the second shielding spring 170 engages through the aperture 190 of the first shielding spring 165. The third spring section 310 can lie against the side surface 215, 220 by way of a fourth outer circumferential side 325. Through the opposing arrangement of the third spring sections 310 in two rows, the position of the second shielding spring 170 is fixed relative to the first shielding spring 165 in the transverse direction.

The second and fourth spring sections 185, 320, as shown in FIG. 6, are arranged running around the longitudinal axis 115 on the common orbit 230. In this case, the fourth spring sections 320 are arranged radially on the outside of the first and second sections 255, 260 of the first shielding spring 165 and are guided past the side of the web sections 265, 270. Through the identical configuration of the first shielding spring 165 and the second shielding spring 170, it is possible to produce the shielding-spring unit 65 in a particularly cost-effective manner. Furthermore, the two shielding springs 165, 170 are complementary such that a spacing between two second spring sections 185 is identical to a spacing between the second spring section 185 and the fourth spring section 320 in the circumferential direction.

Figure 7:
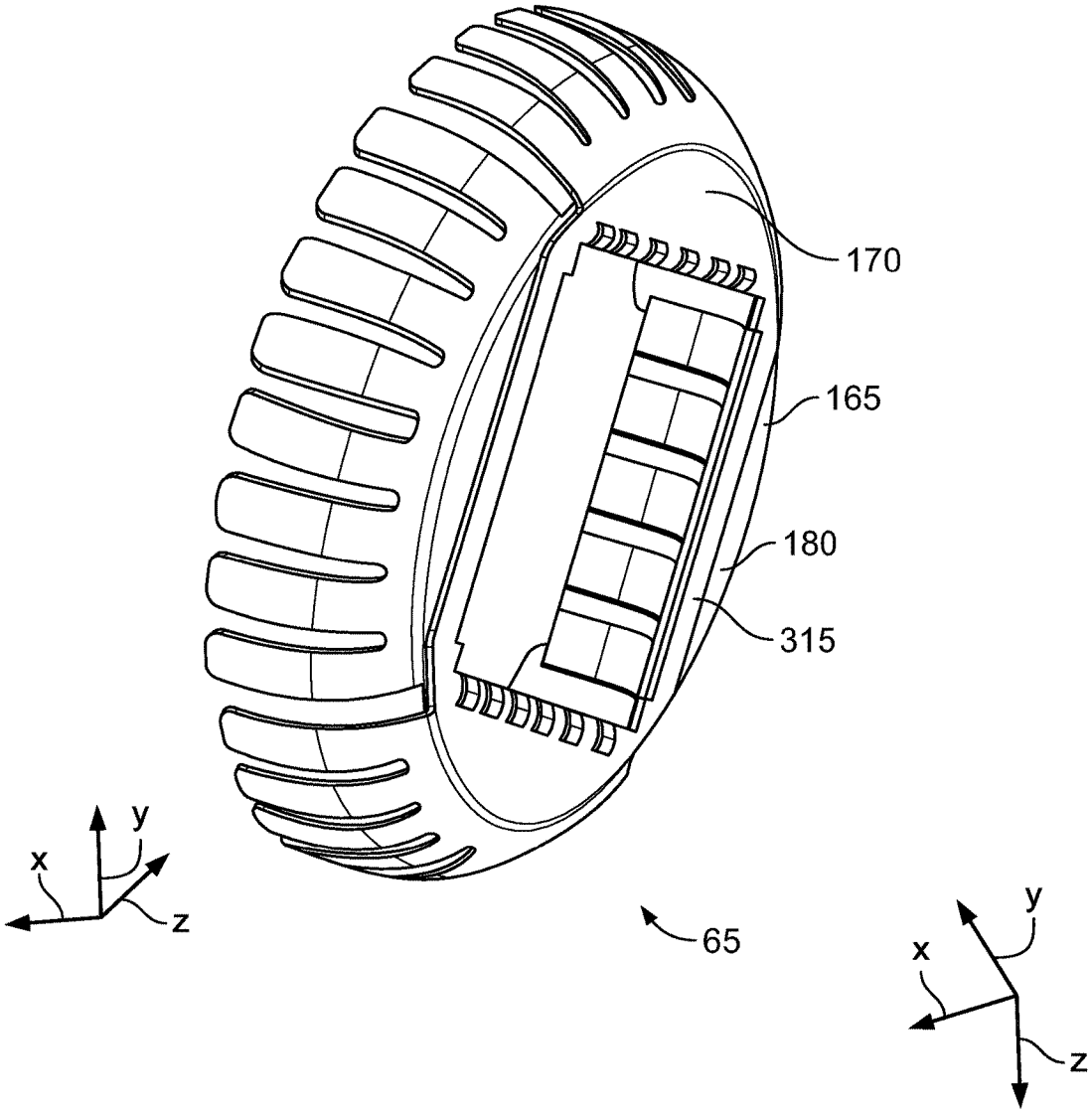
FIG. 7 is a rear perspective view of the shielding spring unit.

As shown in FIG. 7, the second attaching section 315 of the second shielding spring 170 lies, at the rear, against the first attaching section 180 of the first shielding spring 165, so that the shielding-spring unit 65 is formed to be particularly flat in the axial direction. Further, through the contact between the first attaching section 180 and the second attaching section 315, the two shielding springs 165, 170 are electrically connected to one another.

Figure 8:
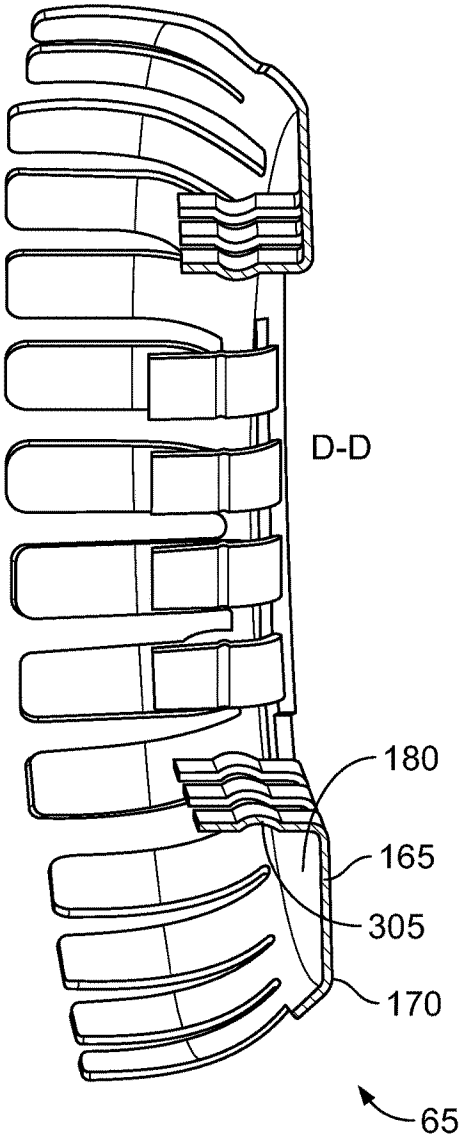
FIG. 8 is a sectional perspective view of the shielding spring unit, taken along line D-D of FIG. 6.

As shown in FIG. 8, in the mounted state on the engagement section 116, the bulge 305 lies on the outer circumferential side 120 of the engagement section 116 and ensures contact to the outer circumferential side 120.

Figure 9:
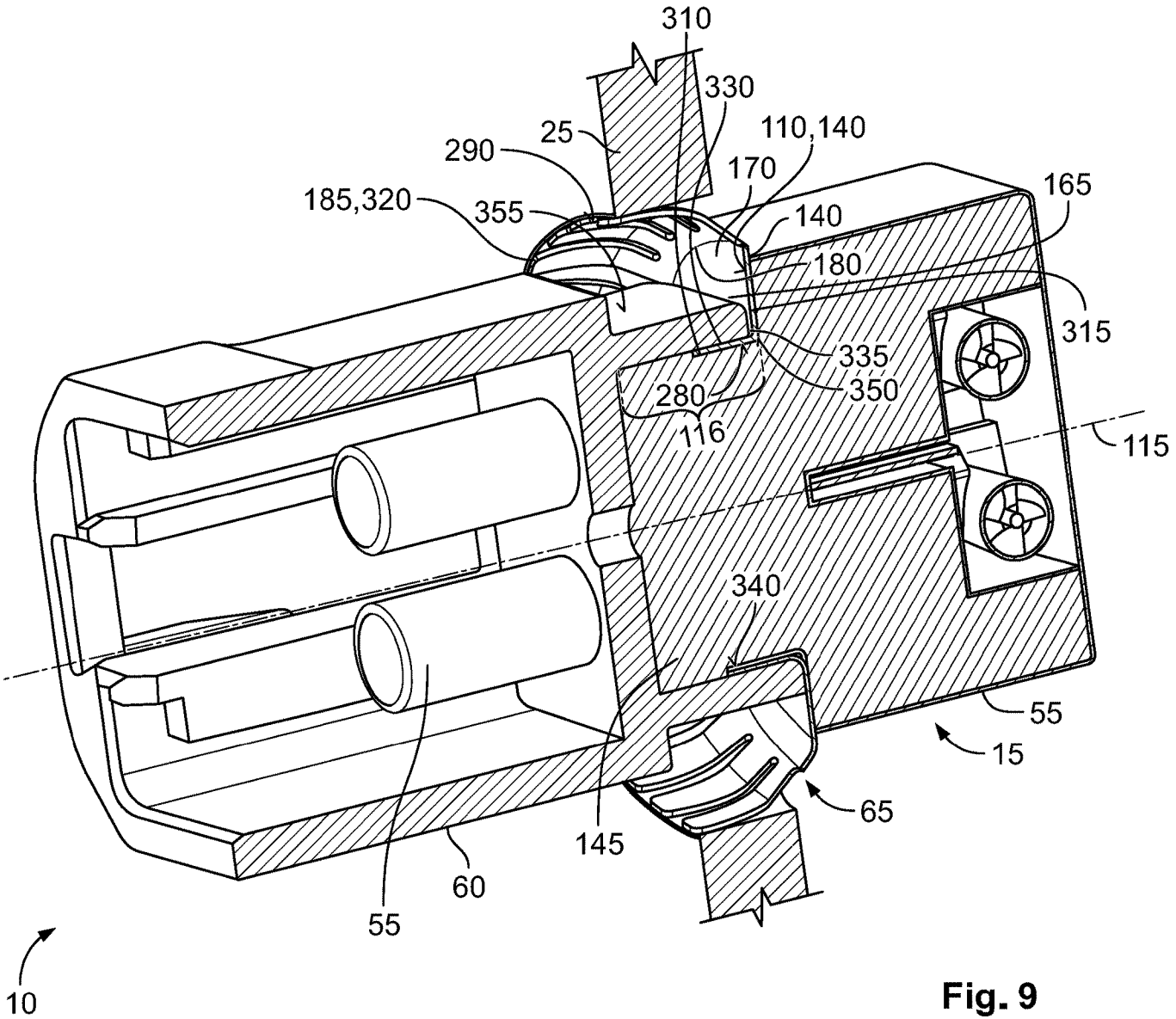
FIG. 9 is a sectional perspective view of the system, taken along line E-E of FIG. 1.

As shown in FIG. 9, the first contact housing 55 has, at the engagement section 116, a first recess 330 which is joined to the offset 140 in the longitudinal direction. The first recess 330 is formed in a groove shape and has approximately the same longitudinal extent in the longitudinal direction as the first spring section 175. The first recess 330 is arranged around the engagement section 116 as a groove circulating around the longitudinal axis 115 in the circumferential direction. When the contact device 15 is in the mounted state, the first spring section 175 of the first shielding spring 165 and the third spring section 310 of the second shielding spring 170 engage with the first recess 330, so that a radial position of the shielding-spring unit 65 is fixed at the engagement section 116.

An axial position of the shielding-spring unit 65 is fixed by the second shielding spring 170 lying at the face side against the offset 140 with the second attaching section 315. In the axial direction with regard to the longitudinal axis 115, the first attaching section 180 of the first shielding spring 165 lies against a second face side 335 which runs parallel to the first face side 110. By the catching of the second contact housing 60 with the first contact housing 55, an axial position of the shielding-spring unit 65 is thus fixed.

On an inner circumferential side 340 of the further receptacle 145, there is arranged a second recess 345; the second recess 345 is joined to the second face side 335 in the longitudinal direction. The second recess 345 is formed as a stepping on the inner circumferential side 340. In this case, the second recess 345 has substantially the same longitudinal extent, with regard to the longitudinal axis 115, as the first recess 330. When the contact device 15 is in the mounted state, the first and third spring sections 175, 310 engage with the first recess 330 and with the second recess 345. In this case, by the first contact surface 280, the first or third spring section 175, 310 lies against a recess base 350 of the first recess 330 and forms an electrical contact to the recess base 350 and thus with the first contact housing 55. The first and third spring sections 175, 310 engage with the second recess 345, wherein the second recess 345 serves to provide a tolerance compensation between the first and third spring sections 175, 310 and the inner circumferential side 340.

As shown in FIG. 9, the second and fourth spring sections 185, 320 are arranged spaced apart from a fifth outer circumferential side 355 of the second contact housing 60. The spring sections 175, 185, 310, 320 extend in the direction of the second contact housing 60 in the longitudinal direction and thus away from the first contact housing 55.

When the contact device 15 is in the mounted state in the control apparatus 10, the second and fourth spring sections 185, 320 form, at the second contact surface 290, an electrical contact to the housing 25 at the first through-hole 35, so that, as a result, the housing 25 is electrically connected to the first contact housing 55 via the shielding-spring unit 65. As a result, a reliable ground contact between the housing 25 and the first contact housing 55 is ensured. Furthermore, through the electrical connection of the first contact housing 55 to the shielding contact 95, a reliable shielding of the signal contact 100 and thus of the signal to be transmitted via the signal contact 100 is ensured.

Through the above-described configuration of the contact device 15, the contact device 15 is on the one hand itself particularly simple to produce and mount, and on the other hand the contact device 15 can provide a particularly good electrical contact to the housing 25. As a result, the contact device 15 shown in FIGS. 1-9 is particularly suitable for transmitting signals in the Gigahertz range, in particular in the range of 0.1 to 100 GHz, in particular in the range of 0.1 to 20 GHz. Furthermore, in this case, a reliable contact is obtained between the substantially rectangularly formed engagement section 116 or the rectangular first contact housing 55 and the circularly formed first through-hole 35. Through the division into two hermaphroditically formed shielding springs 165, 170, the complexity of the production of the contact device 15 can be reduced. The tool for producing the shielding-spring unit 65 is also formed particularly simply.

In the contact device 15 shown in FIGS. 1-9, the dimensioning, in particular the different number of spring sections 175, 185, 310, 320, can be selected differently. It is also conceivable for the second and fourth spring sections 185, 320 to be arranged on an elliptical path or rectangular profile or diamond-shaped profile. The fourth spring sections 320 can also be arranged radially on the outside or radially on the inside relative to the second spring section 185. Of course, a larger number of shielding springs 165, 170, which are mutually complementary to the shielding-spring unit 65, can also be provided. Thus, it is also conceivable, for example, for three or four shielding springs 165, 170 to be provided, which on the one hand are arranged rotated into one another, and on the other hand engage with one another.

Through the above-described configuration, a reliable shielding through 360° can be ensured both by the first and third spring sections 175, 310 and also by the second and fourth spring sections 185, 320.

What is claimed is:

1. A contact device, comprising:

a first contact housing extending along a longitudinal axis; and a shielding-spring unit electrically and mechanically connected to the first contact housing and contacting an electrically conductive housing of a system, the shielding-spring unit has a first shielding spring and a second shielding spring arranged in a rotated manner relative to the first shielding spring in a circumferential direction around the longitudinal axis, the first shielding spring and the second shielding spring engage one another and lie against one another in an axial direction.

2. The contact device of claim 1, wherein the first contact housing has an engagement section extending along the longitudinal axis, the engagement section has a rectangular shape in a cross-section at an outer circumferential side.

3. The contact device of claim 2, wherein the first shielding spring has a first spring section and a second spring section connected to the first spring section, the first spring section electrically contacts the engagement section and mechanically connects the first contact housing to the first shielding spring, the second spring section is arranged radially outwardly with respect to the longitudinal axis relative to the first spring section and has a contact surface for contacting the electrically conductive housing at an outer circumferential side of the second spring section.

4. The contact device of claim 3, wherein the first shielding spring has an attaching section with an aperture, an aperture profile of the aperture and the outer circumferential side of the engagement section are formed at least partially corresponding to one another and prevent rotation between the first shielding spring and the engagement section.

5. The contact device of claim 4, wherein the first spring section is connected to the attaching section at the aperture profile and the second spring section is connected to an outer circumferential side of the attaching section.

6. The contact device of claim 3, wherein the first shielding spring has a plurality of first spring sections arranged spaced apart from one another and extending parallel to one another.

7. The contact device of claim 6, wherein the first contact housing has a first recess at an outside of the engagement section, at least two first spring sections arranged adjacent to one another in the circumferential direction engage the first recess.

8. The contact device of claim 3, wherein the first spring section is oriented parallel or inclined obliquely radially inwards relative to the longitudinal axis and the second spring section is inclined obliquely relative to the longitudinal axis and extends radially outwards.

9. The contact device of claim 4, wherein the first spring section and the second spring section are arranged axially on a common side of the attaching section.

10. The contact device of claim 3, wherein the first shielding spring has a plurality of second spring sections arranged spaced apart from one another in the circumferential direction with respect to the longitudinal axis, the second spring sections are identical to one another.

11. The contact device of claim 4, further comprising a second contact housing with a receptacle, the engagement section and the first spring section engage with the receptacle, the second spring section extends radially on an outside spaced apart from an outer circumferential side of the second contact housing.

12. The contact device of claim 11, wherein the attaching section of the first shielding spring and an attaching section of the second shielding spring are arranged in the axial direction between an offset of the first contact housing and the second contact housing, the offset is joined to the engagement section in the axial direction.

13. The contact device of claim 12, wherein an axial position of the shielding-spring unit is fixed by an abutment of the shielding-spring unit on a face side of the second contact housing and/or by an abutment on the offset.

14. The contact device of claim 3, wherein the second shielding spring has a third spring section and a fourth spring section connected to the third spring section.

15. The contact device of claim 14, wherein the third spring section engages through the first shielding spring in the axial direction and electrically and mechanically connects the second shielding spring to the first contact housing.

16. The contact device of claim 15, wherein the fourth spring section and the second spring section are arranged on a common orbit extending around the longitudinal axis and contact the electrically conductive housing.

17. The contact device of claim 16, wherein the second spring section and the fourth spring section are arranged with regular spacing in the circumferential direction.

18. The contact device of claim 1, wherein the first shielding spring and the second shielding spring are identical to one another.

19. The contact device of claim 1, wherein the first shielding spring is formed integrally and in a materially uniform manner of a spring steel or a copper alloy, the first contact housing is formed in an electrically conductive manner, and/or the first contact housing attaches to and shields a coaxial contact.

20. A system, comprising:

an electrically conductive housing having a through-hole; and a contact device including a first contact housing extending along a longitudinal axis and a shielding-spring unit electrically and mechanically connected to the first contact housing and contacting the electrically conductive housing, the shielding-spring unit has a first shielding spring and a second shielding spring arranged in a rotated manner relative to the first shielding spring in a circumferential direction around the longitudinal axis, the first shielding spring and the second shielding spring engage one another and lie against one another in an axial direction, the first contact housing has an engagement section engaging the through-hole and the first shielding spring and the second shielding spring lie against the through-hole.

21. The contact device of claim 1, wherein the first shielding spring is separate from the second shielding spring.

* * * * *